US007819401B2

(12) United States Patent
Moore

(10) Patent No.: US 7,819,401 B2
(45) Date of Patent: Oct. 26, 2010

(54) PRINT MEDIA ROTARY TRANSPORT APPARATUS AND METHOD

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 612 days.

(21) Appl. No.: 11/595,630

(22) Filed: Nov. 9, 2006

(65) Prior Publication Data

US 2008/0112743 A1 May 15, 2008

(51) Int. Cl.

| | |
|---|---|
| ***B65H 29/00*** | (2006.01) |
| ***B65H 5/00*** | (2006.01) |
| ***B65H 39/10*** | (2006.01) |
| ***B65H 29/20*** | (2006.01) |

(52) U.S. Cl. ..... 271/314; 271/185; 271/225; 271/303

(58) Field of Classification Search ..... 271/184, 271/185, 225, 298, 303

See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,756,521 | A | 7/1988 | Martin |
| 4,836,119 | A | 6/1989 | Siraco et al. |
| 5,004,222 | A | 4/1991 | Dobashi |
| 5,008,713 | A | 4/1991 | Ozawa et al. |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |
| 5,710,968 | A | 1/1998 | Clark et al. |
| 5,778,377 | A | 7/1998 | Marlin et al. |
| 5,884,910 | A | 3/1999 | Mandel |
| 5,995,721 | A | 11/1999 | Rourke et al. |
| 6,059,284 | A | 5/2000 | Wolf et al. |
| 6,125,248 | A | 9/2000 | Moser |
| 6,241,242 | B1 | 6/2001 | Munro |

(Continued)

OTHER PUBLICATIONS

Partial European Search Report for EP 07 11 9998, The Hague, dated Apr. 6, 2009; 4 pages.

(Continued)

*Primary Examiner*—Matthew Luu
*Assistant Examiner*—Kendrick X Liu
(74) *Attorney, Agent, or Firm*—Fay Sharpe LLP

(57) ABSTRACT

This disclosure provides a print media rotary transport apparatus and method of operation. The print media transport apparatus comprises a print media rotary path and a print media rotary bypass path, wherein the print media rotary path rotates a print media sheet about an axis orthogonal to the print media sheet.

21 Claims, 14 Drawing Sheets

U.S. PATENT DOCUMENTS

| | | | | |
|---|---|---|---|---|
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 6,973,286 | B2 | 12/2005 | Mandel et al. | |
| 7,024,152 | B2 | 4/2006 | Lofthus et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0212144 | A1* | 10/2004 | Hozumi | 271/225 |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1* | 12/2004 | Lofthus et al. | 400/582 |
| 2005/0217210 | A1 | 10/2005 | Sting | |
| 2006/0033771 | A1 | 2/2006 | Lofthus et al. | |
| 2006/0039728 | A1 | 2/2006 | deJong et al. | |
| 2006/0066885 | A1 | 3/2006 | Anderson et al. | |
| 2006/0067756 | A1 | 3/2006 | Anderson et al. | |
| 2006/0067757 | A1 | 3/2006 | Anderson et al. | |
| 2006/0114313 | A1 | 6/2006 | Moore | |
| 2006/0114497 | A1 | 6/2006 | Anderson et al. | |
| 2006/0115284 | A1 | 6/2006 | Grace et al. | |
| 2006/0115287 | A1 | 6/2006 | Roof | |
| 2006/0115288 | A1 | 6/2006 | Roof | |
| 2006/0132815 | A1 | 6/2006 | Lofthus et al. | |

OTHER PUBLICATIONS

Morgan, P.F., "Integration of Black Only and Color Printers", Xerox Disclosure Journal, vol. 16, No. 6, Nov./Dec. 1991, pp. 381-383.
Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
U.S. Appl. No. 11/487,206, filed Jul. 14, 2006, Wu et al.
U.S. Appl. No. 11/485,870, filed Jul. 13, 2006, Moore.
U.S. Appl. No. 11/474,247, filed Jun. 23, 2006, Moore.
U.S. Appl. No. 11/483,747, filed Jul. 6, 2006, Meetze.
U.S. Appl. No. 11/495,017, filed Jul. 28, 2006, Bean.
U.S. Appl. No. 11/501,654, filed Aug. 9, 2006, Mestha et al.
U.S. Appl. No. 11/522,171, filed Sep. 15, 2006, Sampath et al.
U.S. Appl. No. 11/528,770, filed Sep. 27, 2006, Degruchy.
U.S. Appl. No. 11/545,176, filed Oct. 10, 2006, deJong et al.

* cited by examiner

290

| | STEP | OPERATION OF DIVERTER DUAL NIP ROTARY TABLE |
|---|---|---|
| 292 | 1 | Diverter Gate 1 directs first sheet off highway to rotary table. |
| 294 | 2 | Rotary table is positioned so that upper stage nip is oriented with input paper travel direction. Lower stage is always perpendicular to upper stage. |
| 296 | 3 | Diverter Gate 2 directs first sheet into upper stage nip of rotary table. |
| 298 | 4 | First sheet is controlled by upper stage nip. Upstream nips are released. |
| 300 | 5 | Rotary table indexes 90 degrees about vertical pivot. First sheet is now rotated 90 degrees. Upper stage is now aligned with exit paper travel direction. Lower stage is now aligned with input paper travel direction. |
| 302 | 6 | First sheet enters orthogonal exit nip and exits to print engine. |
| 304 | 7 | Diverter Gate 1 directs second sheet off highway to rotary table. |
| 306 | 8 | Diverter Gate 2 directs second sheet into lower stage nip of rotary table. |
| 308 | 9 | Second sheet is controlled by lower stage nip. Upstream nips are released. |
| 310 | 10 | Rotary table indexes 90 degrees about vertical pivot. Second sheet is now rotated 90 degrees. Lower stage is now aligned with exit paper travel direction. Upper stage is now aligned with input paper travel direction. |
| 312 | 11 | Process steps 1-10 repeated for subsequent sheets. |

FIG. 8

500

| | STEP | OPERATION OF COLLECTOR DUAL NIP ROTARY TABLE |
|---|---|---|
| 502 | 1 | Print engine sends first sheet to collector module entrance. |
| 504 | 2 | Rotary table is positioned so that upper stage nip is oriented with input paper travel direction. Lower stage is always perpendicular to upper stage. |
| 506 | 3 | Diverter Gate (not shown) directs first sheet into upper stage nip of rotary table. |
| 508 | 4 | First sheet is controlled by upper stage nip. Upstream nip or nips are released. |
| 510 | 5 | Rotary table indexes 90 degrees about vertical pivot. First sheet is now rotated 90 degrees. Upper stage is now aligned with exit paper travel direction. Lower stage is now aligned with input paper travel direction. |
| 512 | 6 | First sheet enters exit transport nip and merges onto collection highway. |
| 514 | 7 | Print engine sends second sheet to collector module entrance. |
| 516 | 8 | Diverter Gate (not shown) directs second sheet into lower stage nip of rotary table. |
| 518 | 9 | Second sheet is controlled by lower stage nip. Upstream nip or nips are released. |
| 520 | 10 | Rotary table indexes 90 degrees about vertical pivot. Second sheet is now rotated 90 degrees. Lower stage is now aligned with exit paper travel direction. Upper stage is now aligned with input paper travel direction. |
| 522 | 11 | Process steps 1-10 repeated for subsequent sheets. |

FIG. 13

PRINT MEDIA ROTARY TRANSPORT APPARATUS AND METHOD

CROSS REFERENCE TO RELATED PATENTS AND APPLICATIONS

The following patents/applications, the disclosures of each being totally incorporated herein by reference are mentioned:

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Pat. No. 7,123,873, issued Oct. 17, 2006, entitled "PRINTING SYSTEM WITH INVERTER DISPOSED FOR MEDIA VELOCITY BUFFERING AND REGISTRATION," by Joannes N. M. dejong, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. Publication No. US-2006-0176336-A1, Published Aug. 10, 2006, entitled "PRINTING SYSTEMS," by Steven R. Moore, et al.;

U.S. Publication No. US-2006-0214364-A1, Published Sep. 28, 2006, entitled "SHEET REGISTRATION WITHIN A MEDIA INVERTER," by Robert A. Clark, et al.;

U.S. Publication No. US-2006-0214359-A1, Published Sep. 28, 2006, entitled "INVERTER WITH RETURN/BY-PASS PAPER PATH," by Robert A. Clark;

U.S. Publication No. US-2006-0222378-A1, Published Oct. 5, 2006, entitled "PRINTING SYSTEM," by Paul C. Julien;

U.S. Publication No. US-2006-0221159-A1, Published Oct. 5, 2006, entitled "PARALLEL PRINTING ARCHITECTURE WITH PARALLEL HORIZONTAL PRINTING MODULES," by Steven R. Moore, et al.;

U.S. application Ser. No. 11/109,566 filed Apr. 19, 2005, entitled "MEDIA TRANSPORT SYSTEM," by Barry P. Mandel, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/331,627, filed Jan. 13, 2006, entitled "PRINTING SYSTEM I U.S. application Ser. No. 11/349,828, filed Feb. 8, 2005, entitled "MULTI-DEVELOPMENT SYSTEM PRINT ENGINE", by Martin E. Banton; and U.S. application Ser. No. 11/359,065, filed Feb. 22, 2005, entitled "MULTI-MARKING ENGINE PRINTING PLATFORM", by Martin E. Banton.

BACKGROUND

The present disclosure generally relates to printing systems and methods. More specifically, the present disclosure relates to a print media rotary transport system and method to transport print media from a first print media transport module, pathway, highway, printer, etc., to a second print media transport module, pathway, highway printer, etc.

To provide for increased printing capabilities, some conventional printing systems include multiple printing modules which are interfaced with a common print media sheet feeder and/or a common print media sheet finishing system. One benefit of such an integrated printing system is increased production speed. These so-called "cluster printing systems" enable relatively higher print rates by grouping a number of printing modules in parallel. In addition, those cluster printing systems can provide an improvement in overall system reliability because of the redundancy provided with multiple printing modules. For example, if one printing module is taken off-line for service or repair, other printing modules are available to continue meeting the output requirements of the overall printing system. In addition to the benefits associated with a cluster or parallel printing system related to overall printing speed and reliability, a cluster printing system enables the integration of multiple marking engines for black, color and custom color printing of selected pages within a print job by a specific marking engine. The printed media sheets from the plurality of marking engines are subsequently merged in a predetermined sequence to produce the completed print job. Merging of the printed media sheets is performed by what is sometimes referred to as a merger module.

One challenge associated with conventional cluster printing systems is transporting the print media to the respective printing modules or marking engines for printing, and transporting the printed media document to a printing system output and/or finishing system.

Conventional printing systems utilize horizontal and vertical print media paths incorporating nips and rollers to facilitate the movement of print media sheets within the overall printing system. The print media paths interconnect the various printing system modules to provide a complete cluster printing system.

In addition to horizontal and vertical print media paths, conventional cluster printing systems incorporate print media rotators to provide print media routing between orthogonally aligned print media pathways.

One printing system that provides a print media transport system including a rotator is U.S. patent application Ser. No. 11/291,583, filed on Nov. 30, 2005. The rotator disclosed rotates a print media about an axis parallel to the sheet plane.

This disclosure provides a printing system and method of rotating a print media sheet about an axis orthogonal to the sheet plane.

INCORPORATION BY REFERENCE

The following references, the disclosures of which are incorporated by reference in their entireties, relate to what have been variously called "tandem engine" printers, "cluster printing," and "output merger" or "interposer" systems: U.S. patent application Ser. No. 11/291,583, filed Nov. 30, 2005, entitled "MIXED OUTPUT PRINTING SYSTEM," by Joseph H. Lang; U.S. Pat. No. 4,579,446, issued Apr. 1, 1986 to Fujino et al., entitled "BOTH-SIDE RECORDING SYSTEM"; U.S. Pat. No. 4,587,532, issued May 6, 1986 to Asano, entitled "RECORDING APPARATUS PRODUCING MULTIPLE COPIES SIMULTANEOUSLY"; U.S. Pat. No. 5,272,511, issued Dec. 21, 1993 to Conrad et al., entitled "SHEET INSERTER AND METHODS OF INSERTING SHEETS INTO A CONTINUOUS STREAM OF SHEETS"; U.S. Pat. No. 5,568,246, issued Oct. 22, 1996 to Keller et al., entitled "HIGH PRODUCTIVITY DUAL ENGINE SIMPLEX AND DUPLEX PRINTING SYSTEM USING A REVERSIBLE DUPLEX PATH"; U.S. Pat. No. 5,570,172, issued Oct. 29, 1996 to Acquaviva, entitled "TWO UP HIGH SPEED PRINTING SYSTEM"; U.S. Pat. No. 5,995,721, issued Nov. 30, 1999 to Rourke et al., entitled "DISTRIBUTED PRINTING SYSTEM"; U.S. Pat. No. 5,596,416, issued Jan. 21, 1997 to Barry et al., entitled "MULTIPLE PRINTER MODULE ELECTROPHOTOGRAPHIC PRINTING DEVICE"; U.S. Pat. No. 6,402,136, issued Jun. 11, 2002 to Lamothe, entitled "APPARATUS FOR MERGING MULTIPLE STREAMS OF DOCUMENTS INTO A SINGLE STREAM"; U.S. Pat. No. 6,925,283, issued Aug. 2, 2005 to Mandel et al., entitled "HIGH PRINT RATE MERGING AND FINISHING SYSTEM FOR PRINTING"; U.S. Pat. No. 6,959,165, issued Oct. 25, 2005 to Mandel et al., entitled "HIGH PRINT RATE MERGING AND FINISHING SYSTEM FOR PRINTING"; a 1991 "Xerox Disclosure Journal" publication of November-December 1991, Vol. 16, No. 6, pp. 381-383; and the Xerox Aug. 3, 2001 "TAX" publication product announcement entitled "Cluster Printing Solution Announced."

BRIEF DESCRIPTION

According to one aspect of this disclosure, a print media rotary transport apparatus is disclosed. The print media rotary transport apparatus comprises a print media input; a print media rotary bypass operatively connected to the print media input; a print media rotary transport operatively connected to the print media input; a first print media output operatively connected to the print media rotary bypass; and a second print media output operatively connected to the print media rotary transport, wherein the print media rotary bypass is configured to selectively receive a print media sheet and transport the print media sheet to the first print media output, and the print media rotary transport is configured to selectively receive a print media sheet, rotate the print media sheet about an axis orthogonal to the print media sheet plane, and transport the rotated print media sheet to the second print media output.

According to another aspect of this disclosure, a print media rotary transport apparatus is disclosed. The print media rotary transport apparatus comprises a first print media input; a second print media input; a print media rotary bypass operatively connected to the first print media input; a print media rotary transport operatively connected to the second print media input; a print media output operatively connected to the print media rotary bypass and operatively connected to the print media rotary transport, wherein the print media rotary bypass is configured to selectively receive a print media sheet and transport the print media sheet to the print media output, and the print media rotary transport is configured to selectively receive a print media sheet, rotate the print media sheet about an axis orthogonal to the print media sheet plane, and transport the rotated print media sheet to the print media output.

According to another aspect of this disclosure, a printing system is disclosed. The printing system comprises a first printing module comprising a print media input; and a print media output; and a print media diverter module comprising a print media input; a first print media output; and a second print media output operatively connected to the first printing module print media input, wherein the diverter module is configured to selectively rotate a print media sheet about an axis orthogonal to the print media sheet plane and rotate the print media sheet a predetermined angle for routing the print media sheet to the first printing module print media input for subsequent image marking, and the diverter module is configured to selectively route a print media sheet from the print media input to the first print media output.

According to another aspect of this disclosure, a printing system is disclosed. The print system comprises a first printing module comprises a print media input; and a print media output; and a print media collector module comprising a first print media input; a second print media input; and a print media output, wherein the second print media input is operatively connected to the first printing module print media output and the collector module is configured to selectively rotate a print media sheet routed from the first printing module print media output a predetermined angle and selectively route a print media sheet from the collector first print media input to the print media collector output.

According to another aspect of this disclosure, a xerographic printing system is disclosed. The xerographic print system comprises two or more printing modules substantially aligned in parallel; two or more print media diverter modules; and two or more print media collector modules. Each print media diverter is operatively connected to a respective printing module input and each print media collector is operatively connected to a respective printing module output.

BRIEF DESCRIPTION OF THE DRAWINGS

FIG. 8 is a flow chart illustrating the operation of a diverter dual NIP rotary table according to an exemplary embodiment of this disclosure;

FIG. 13 is a flow chart illustrating the operation of a Collector Dual NIP Rotary Table;

DETAILED DESCRIPTION

This disclosure provides a print media rotary transport apparatus and method of operating the same. As briefly discussed in the background section, the exemplary embodiment of the print media rotary transport apparatus are especially suited for the integration of a plurality of printing modules and/or printing systems.

Figure 1:
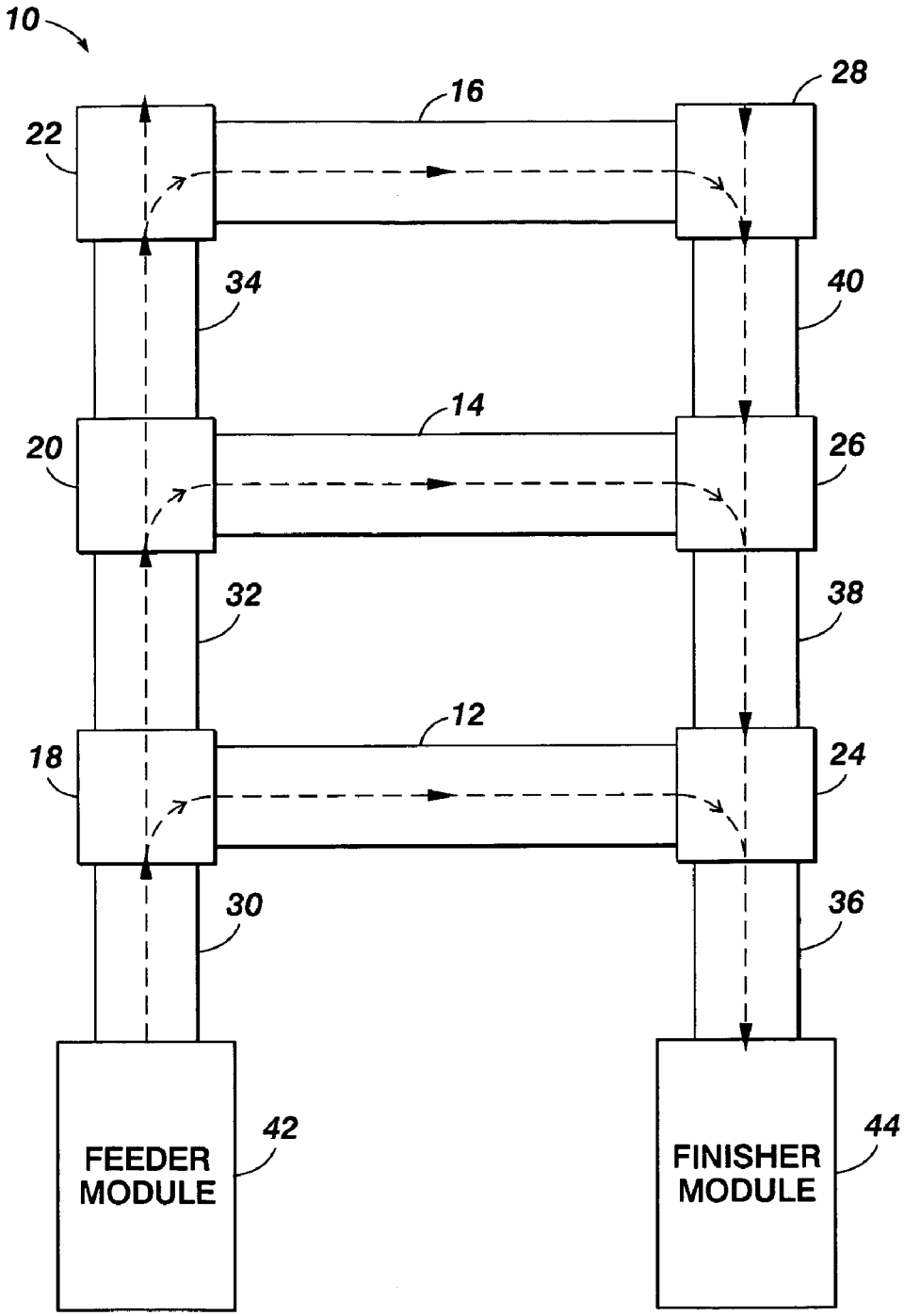
FIG. 1 is an illustration of a printing system according to an exemplary embodiment of this disclosure.

With reference to FIG. 1, illustrated is a printing system 10 according to an exemplary embodiment of this disclosure. The printing system comprises a first printing system 12, a second printing system 14, a third printing system 16, a first diverter module 18, a second diverter module 20, a third diverter module 22, a first collector module 24, a second collector module 26, a third collector module 28, a first bridge transport module 30, a second bridge transport module 32, a third bridge transport module 34, a fourth bridge transport module 36, a fifth bridge transport module 38, a sixth bridge transport module 40, a print media sheet feeder module 42 and a print media finisher module 44.

In operation, the printing system 10 executes printing jobs communicated to the printing system 10 via a network, controller, user interface, etc. To execute a printing job, print media sheets enter the printing system 10 via the feeder module 42 which is operatively connected to the first bridge transport module 30 input. Depending on the printing requirements of a print job, the print media sheets may be routed via the transport modules and respective diverter modules to either the first printing module 12, second printing module 14 or third printing module 16. These printing modules may be any combination of color, and/or black and white printing or other image marking engines.

Notably, each diverter module 18, 20 and 22 comprises a print media rotary bypass and a print media rotary transport. In operation, the first diverter module 18 routes a media sheet to the second 14 or third 16 printing modules bypassing the first printing module 12 via the first diverter module 18. Alternatively, any printed media sheets requiring image marking by the first printing module 12 will be routed to the first diverter module 18 where the print media sheet is rotated approximately 90° about an axis orthogonal to the print media sheet plane. Subsequently, the print media sheet is routed through the first printing module 12 for image marking.

After the print media sheet is image marked with the first printing module 12, the print media sheet is routed to the input of the first collector module 24 which rotates the printed media sheet approximately 90° about an axis orthogonal to the print media sheet and routes the printed media sheet to the fourth bridge transport module 36. The bridge transport module 36 routes the printed media sheet to the finisher module 44 which may include stacking and/or other operations.

In addition to rotating printed media sheets from the first printing module 12, the first collector module 24 includes a print media rotary bypass which transports printed media sheets from the fifth bridge transport module 38 output to the fourth bridge transport module 36 for further routing to the finisher module 44. The second 20 and third 22 diverter modules operate similarly to the first diverter module, and the second 26 and third 28 collector modules operate similarly to the first collector module 24.

Notably, the printing system 10 illustrated in FIG. 1 and disclosed heretofore can integrate a plurality of substantially horizontally aligned extant printing systems. The integration of each printing system or module includes the addition of a respective diverter module and collector module, where the diverter and collector modules comprise a print media rotary transport and a print media rotary transport bypass and the rotary transports rotate a print media sheet about an axis orthogonal to the print media sheet plane.

Figure 2:
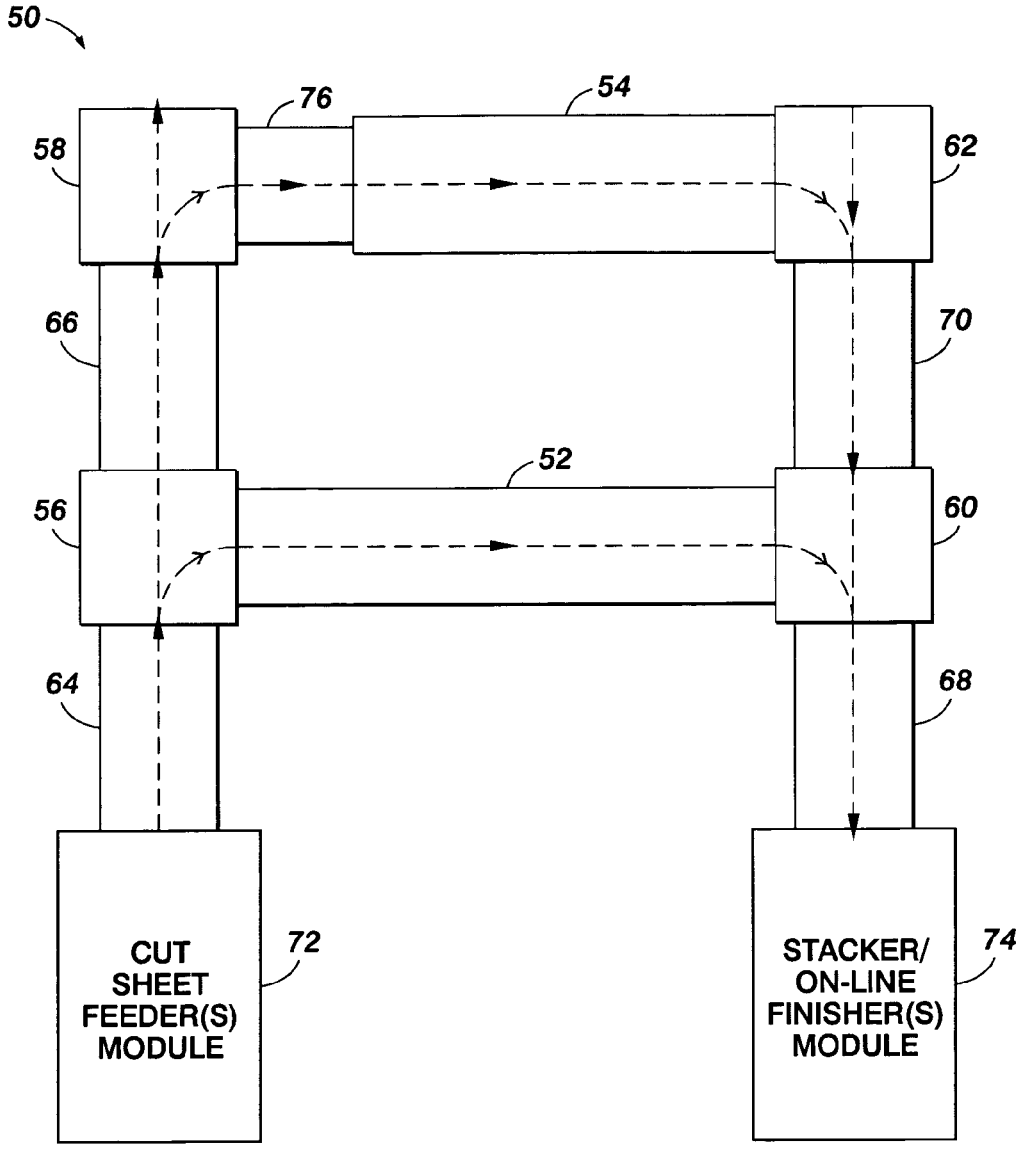
FIG. 2 is an illustration of another printing system according to an exemplary embodiment of this disclosure.

With reference to FIG. 2, illustrated is another exemplary embodiment of a printing system 50 according to this disclosure. The printing system 50 comprises a first printing module 52, a second printing module 54, a first diverter module 56, a second diverter module 58, a first collector module 60, a second collector module 62, a first bridge transport module 64, a second bridge transport module 66, a third bridge transport module 68, a fourth bridge transport module 70, a cut sheet feeder(s) module 72 and a stacker/on-line finisher(s) module 74. In addition, this printing system 50 comprises a fifth bridge transport module 76 which provides print media routing from an output of the second diverter module 58 to a print media input of the second printing module 54.

In operation, this printing system operates as discussed with reference to FIG. 1, except the printing system includes only two printing modules. Moreover, the additional bridge transport module 76 provides a means for integrating printing modules of different lengths or footprints while providing an integrated printed system comprising a plurality of substantially horizontally aligned printing modules and/or systems.

Figure 3:
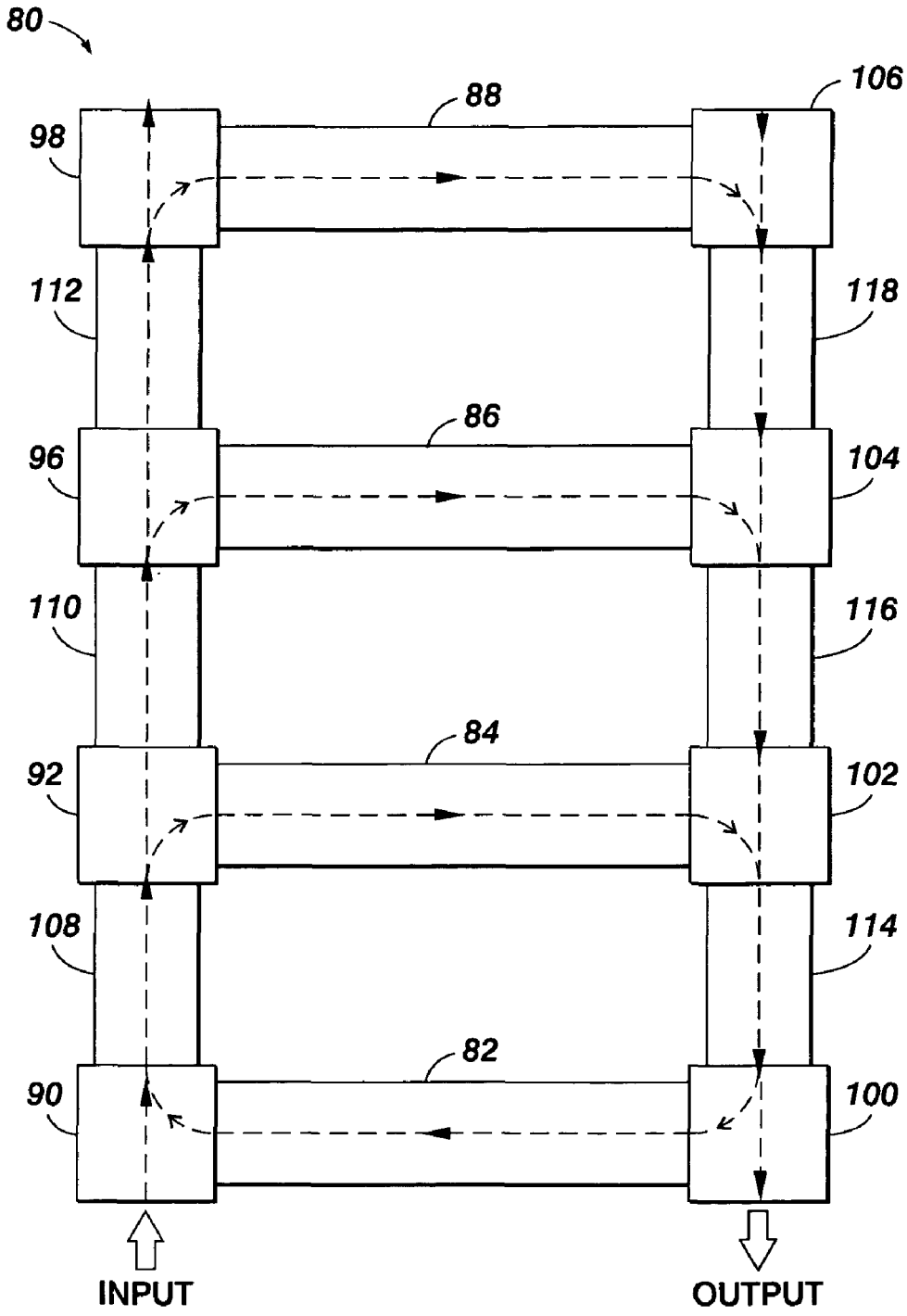
FIG. 3 is an illustration of another printing system according to an exemplary embodiment of this disclosure.

With reference to FIG. 3, illustrated is another printing system according to an exemplary embodiment of this disclosure. The printing system comprises a first printing module 84, a second printing module 86, a third printing module 88, a first diverter module 90, a second diverter module 92, a third diverter module 96, a fourth diverter module 98, a first collector module 100, a second collector module 102, a third collector module 104, a fourth collector module 106, a first bridge transport module 108, a second bridge transport module 110, a third bridge transport module 112, a fourth bridge transport module 114, a fifth bridge transport module 116, a sixth bridge transport module 118 and a return transport module 82. The printing system 80 operates similarly to the printing systems described with reference to FIG. 2 and FIG. 3 with the added functionality of a print media sheet return path as provided by the return transport module 82.

Figure 4A:
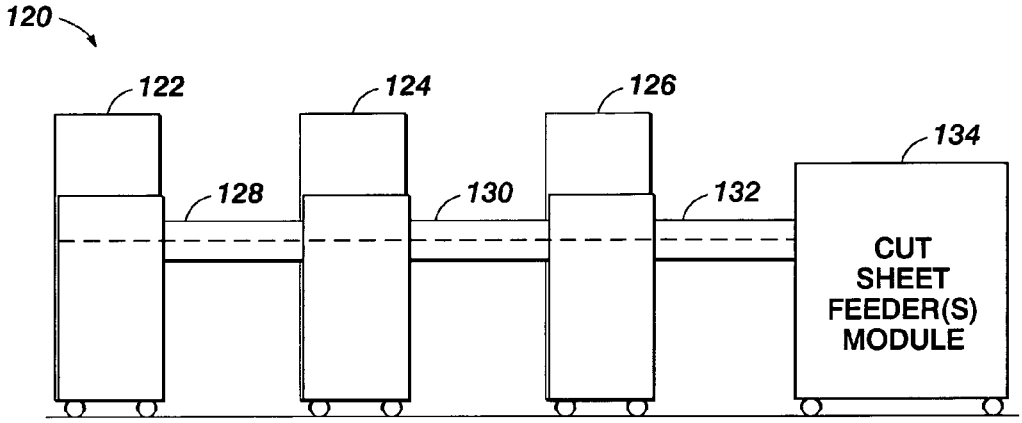
FIG. 4A is a side view of a printing system including a pivoting bridge transport module according to an exemplary embodiment of this disclosure.
Figure 4B:
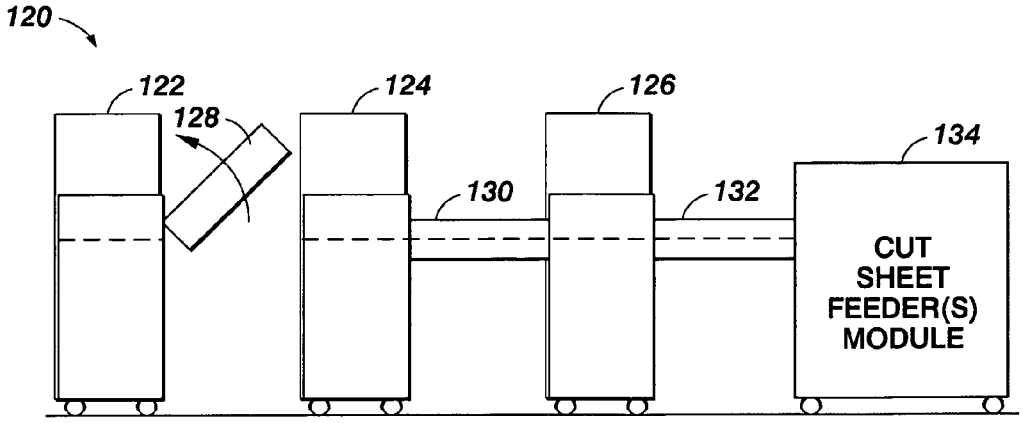
FIG. 4B is another side view of a printing system including a pivoting bridge transport module according to an exemplary embodiment of this disclosure.

With reference to FIG. 4A and FIG. 4B, illustrated is another printing system 120 according to an exemplary embodiment of this disclosure. The printing system comprises a first printing module 122, a second printing module 124, a third printing module 126, a first bridge transport module 128, a second bridge transport module 130, a third bridge transport module 132, and a cut sheet feeder(s) module 134. In addition, diverter and collector modules integrate the printing modules, bridge transports and cut sheet feeder modules. To provide a user with access to service each printing module, the printing system 120 comprises one or more removable bridge transport modules, for example a pivoting or swing-away bridge transport as illustrated in FIG. 4B. Notably, the printing system 120 may comprise electronic sensors to indicate the presence or absence of the bridge transports, where a respective printing module is non-allocatable for a print job execution during serviceability, etc.

Figure 5A:
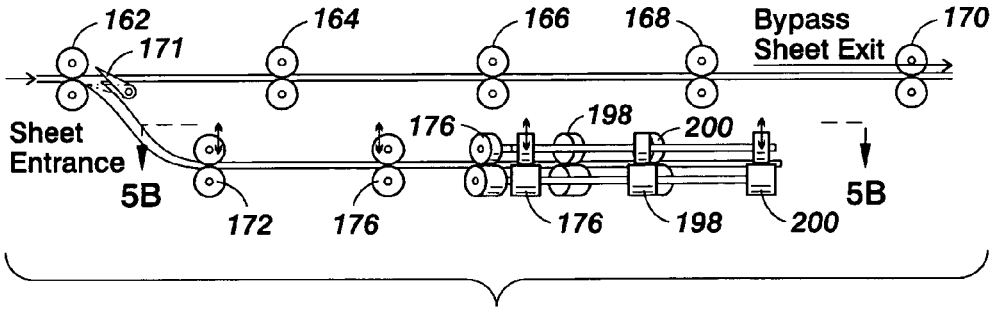
FIG. 5A is a side view of a diverter module according to an exemplary embodiment of this disclosure.
Figure 5B:
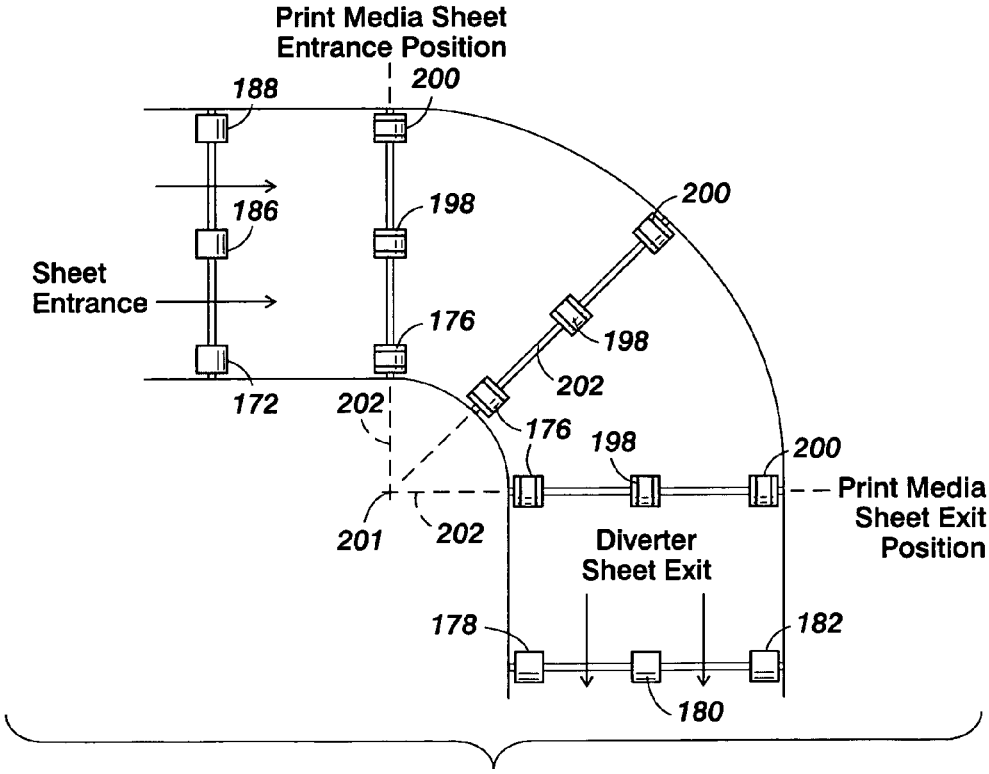
FIG. 5B is a top view (view "5B" identified in FIG. 5A) of a diverter according to an exemplary embodiment of this disclosure.

With reference to FIGS. 5A and 5B, illustrated is a side view and sectional top view, respectively, of a diverter module according to an exemplary embodiment of this disclosure. The diverter module includes a print media rotary transport and a print media rotary transport bypass. The print media rotary transport comprises transport nips 172, 186, 188; a pivoting arm 202 comprising rotary nips 176, 198 and 200; and print media exit nips 178, 180 and 182. The print media rotary bypass comprises nip assemblies 162, 164, 166, 168 and 170.

Figure 6:
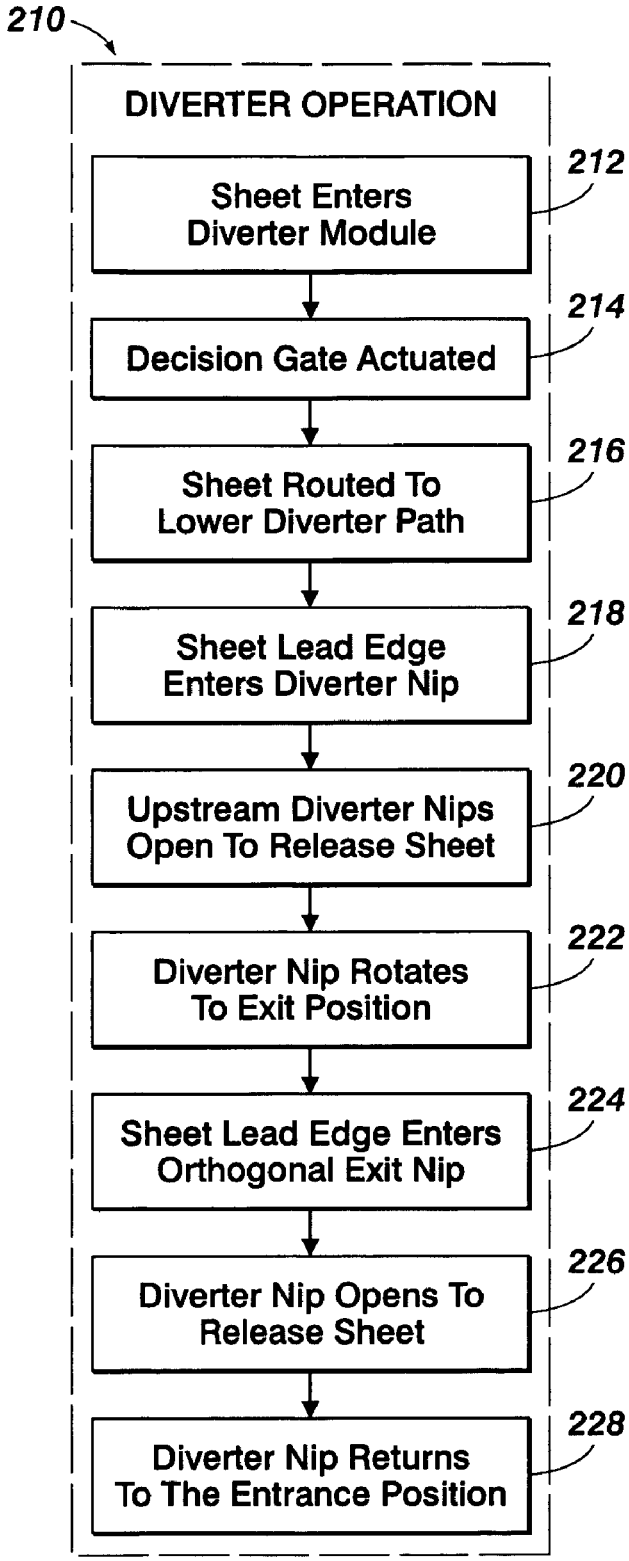
FIG. 6 is a flow chart illustrating the operation of a diverter according to an exemplary embodiment of this disclosure.

With reference to FIG. 6, illustrated is an exemplary method of operating the diverter module illustrated in FIGS. 5A and 5B. Initially, a print media sheet enters 212 the diverter module at the entry nip 162.

Next, the decision gate 171 is actuated 214 upwardly to route 216 the print media sheet towards the lower diverter path where pinch nips 172, 186 and 188 drive the print media sheet leading edge towards the diverter nips 176, 198 and 200.

Next, the print media sheet leading edge enters 218 the rotary/diverter nips 176, 198 and 200, and the upstream transport nips 172, 186, and 188 open to release 220 the print media sheet.

Next, the diverter nips 176, 198 and 200 rotate 222 by means of a pivoting arm 202 which pivots about pivot center 201 to a print media exit position.

Next, the print media sheet leading edge enters 224 exit nip 178, 180 and 182, and the rotary/diverter nips 176, 198 and 200 release 226 the print media sheet.

Finally, the rotary/diverter nips 176, 198 and 200 are returned 228 to the print media sheet entrance position by the pivoting arm 202.

Figure 7A:
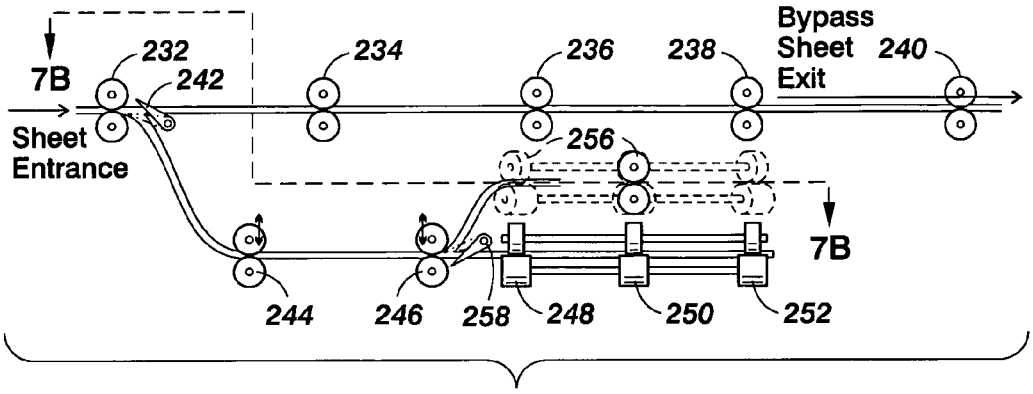
FIG. 7A is a side view of a diverter module according to an exemplary embodiment of this disclosure.
Figure 7B:
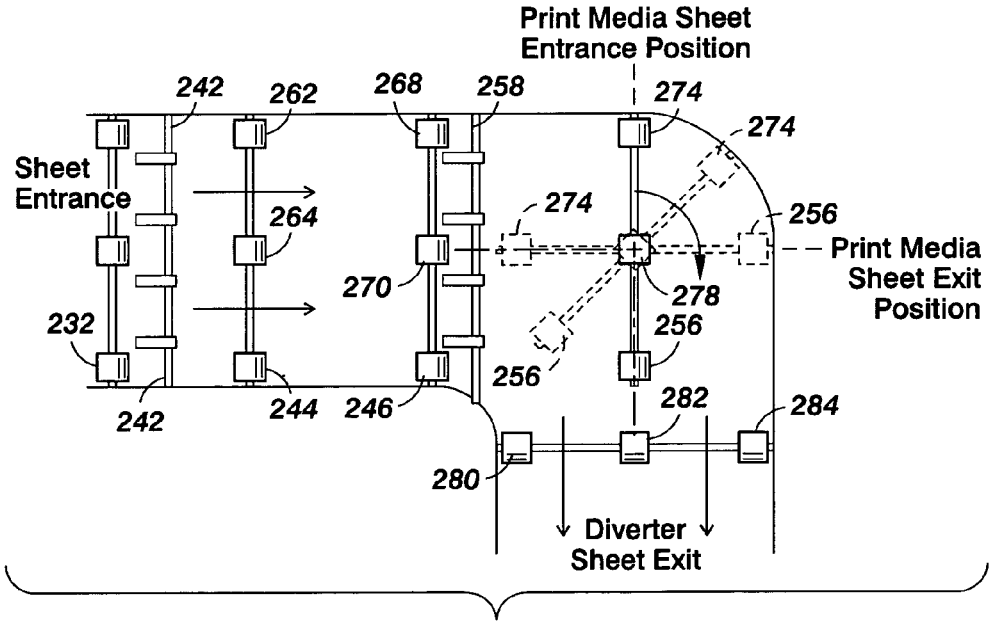
FIG. 7B is a top view (view "7B" identified in FIG. 7A) of a diverter according to an exemplary embodiment of this disclosure.

With reference to FIGS. 7A and 7B, illustrated is a side view and sectional top view, respectively, of a diverter module according to another exemplary embodiment of this disclosure. The diverter module comprises a print media rotary transport and a print media rotary transport bypass. The print media rotary transport comprises transport nips 244, 264, 262, 246, 270 and 268; an upper stage pivoting arm comprising rotary nips 256, 278 and 274; a lower stage pivoting arm comprising rotary nips 248, 250 and 252; a first decision gate 242; a second decision gate 258; and exit nips 280, 282 and 284. The print media rotary transport comprises entry nip 232; and transport nips 234, 236, 238 and 240.

In operation, the first decision gate 242 routes an entering media sheet to either the bypass or rotary transport by rotating the gate body downwardly or upwardly, respectively. A print media sheet routed to the rotary transport is initially driven by nips 244, 264 and 262. Subsequently, the print media sheet is routed to the upper stage nips 256, 278, and 274, or the lower stage nips 248, 250 and 252, by decision gate 258.

As illustrated in FIG. 7A, the upper nips 256, 278 and 274 are initially positioned to receive the media sheet while the lower nips 248, 250 and 252 are initially positioned orthogonal to the upper nips 256, 278 and 274. To divert or rotate the media sheet, the upper nips 256, 278 and 274 are rotated approximately 90° about a center associated with the upper nips while the lower nips are rotated approximately 90° about the same center, where the lower nips are rotated to receive the next print media sheet directed by the decision gate 258 and the upper nips are rotated to route the diverted/rotated print media sheet to exit nips 280, 282 and 284.

Notably, the diversion/rotation of the next media sheet is accomplished by the lower stage rotary nips 248, 250 and 252 while the upper stage nips 256, 278 and 274 are rotated to the print media sheet entrance position indicated in FIG. 7B, where the cycle is repeated.

With reference to FIG. 8, a method 290 of operating a diverter module according to FIGS. 7A and 7B is illustrated.

Initially, diverter gate 1 242 directs 292 a first media sheet off the highway to the rotary table.

Next, the rotary table is positioned 294 so that the upper stage nips are oriented with the input paper travel direction.

Next, diverter gate 2 258 directs 296 the first media sheet into the upper stage nip of the rotary table.

Next, the first media sheet is controlled 298 by the upper stage nip and the upstream nips are released.

Next, the rotary table indexes 300 90 degrees about a vertical pivot axis. The first media sheet is rotated 90 degrees and the upper stage is now aligned with the media sheet exit direction; while the lower stage is aligned with the media sheet input direction.

Next, the first media sheet enters 302 the orthogonal exit nip and continues to travel to a printing module.

Next, diverter gate 1 242 directs 304 a second media sheet off the highway to the rotary table.

Next, diverter gate 2 258 directs 306 a second media sheet into the lower stage nip of the rotary table.

Next, the second media sheet is controlled 308 by the lower stage nip and the upstream nips are released.

Next, the rotary table indexes 310 90 degrees about a vertical pivot axis and the second media sheet is now rotated 90 degrees. This results in the lower stage being aligned with the media sheet exit direction and the upper stage being aligned with the media sheet input direction.

Next, the above steps are repeated 312 for subsequent sheets.

Figure 9A:
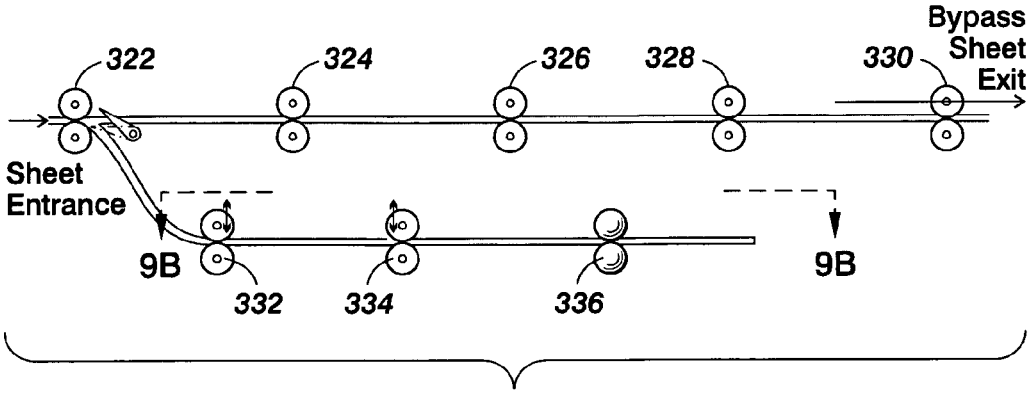
FIG. 9A is a side view of a diverter module according to an exemplary embodiment of this disclosure.
Figure 9B:
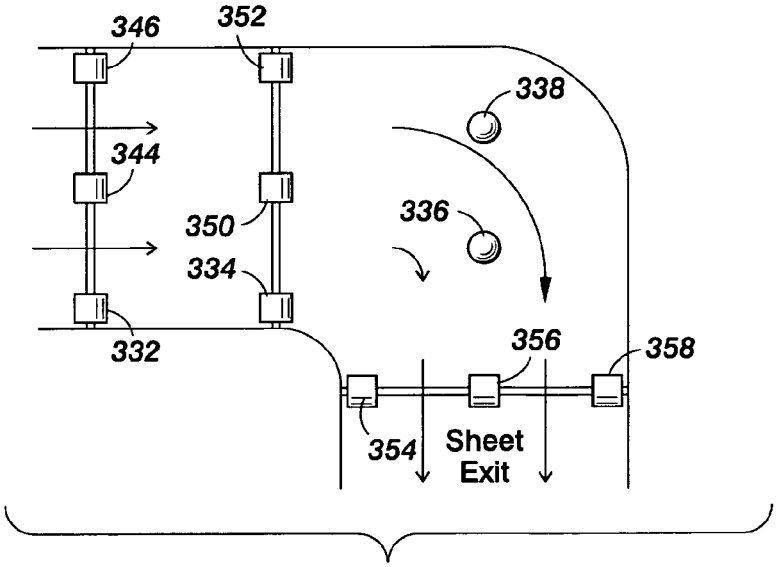
FIG. 9B is a top view (view "9B" indicated in FIG. 9A) of a diverter according to an exemplary embodiment of this disclosure.

With reference to FIG. 9A and FIG. 9B, illustrated is a side view and sectional top view, respectively, of a diverter module according to another exemplary embodiment of this disclosure. The diverter module comprises a print media rotary transport and a print media rotary transport bypass. The print media rotary transport comprises entry nips 332, 344 and 346; transport nips 334, 350 and 352; rotary nips 336 and 338; and exit nips 354, 356 and 358. The print media rotary transport bypass comprises transport nips 322, 324, 326, 328 and 330.

Notably, the diverter module illustrated in FIGS. 9A and 9B operates similarly to the diverter module illustrated and described with reference to FIGS. 5A and 5B, except the print media rotary transport includes spherically shaped rotary nips 336 and 338. The spherically shaped rotary nips 336 and 338 provide 90 degree indexing/rotation of a media sheet.

Figure 10A:
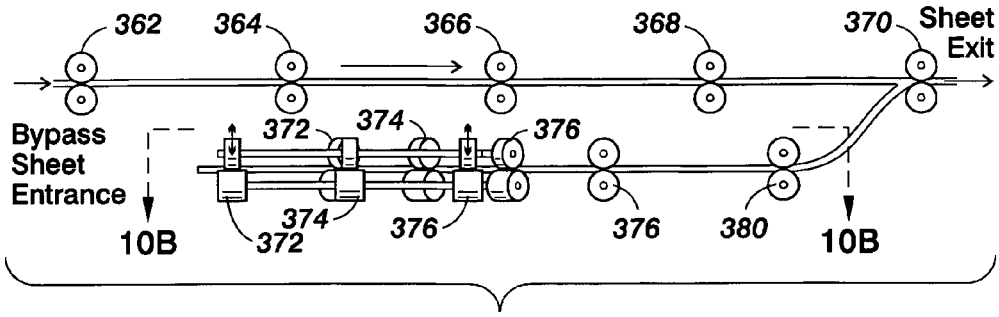
FIG. 10A is a side view of a collector module according to an exemplary embodiment of this disclosure.
Figure 10B:
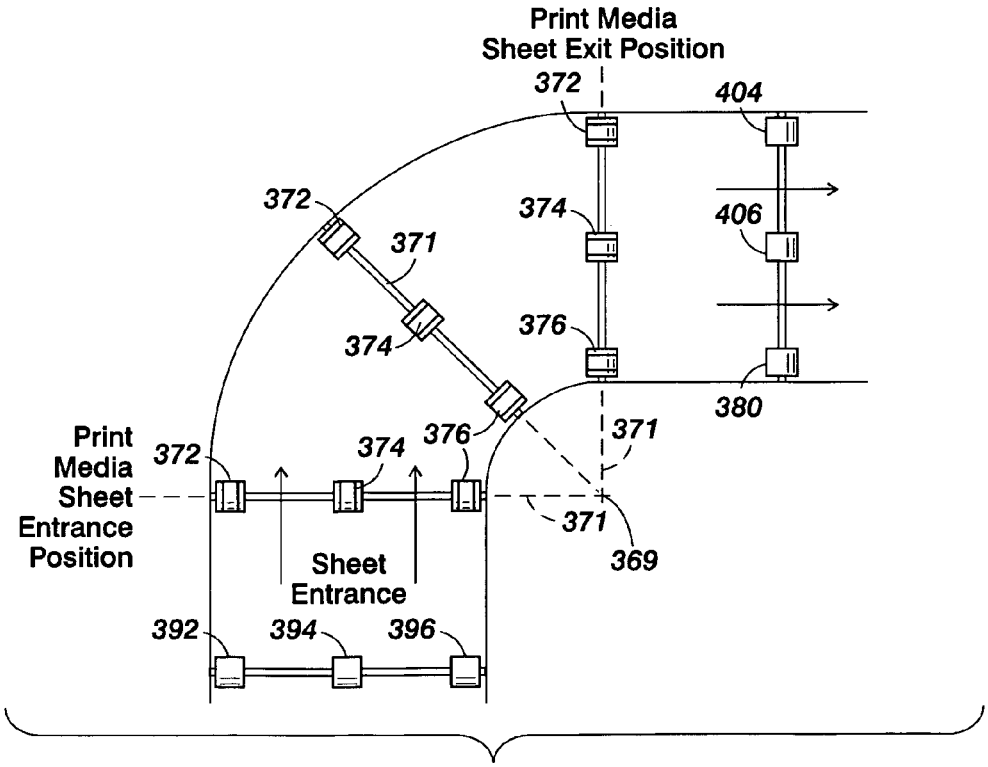
FIG. 10B is a top view (view "10B" indicated in FIG. 10A) of a collector according to an exemplary embodiment of this disclosure.

With reference to FIGS. 10A and 10B, illustrated is a side view and sectional top view, respectively, of a collector module according to an exemplary embodiment of this disclosure. The collector module includes a print media rotary transport and a print media rotary transport bypass.

The print media rotary transport comprises transport nips 380, 406 and 404; a pivoting arm 371 comprising rotary nips 376, 374 and 372; and print media exit nips 392, 394 and 396. The print media rotary bypass comprises nip assemblies 362, 364, 366, 368 and 370.

Figure 11:
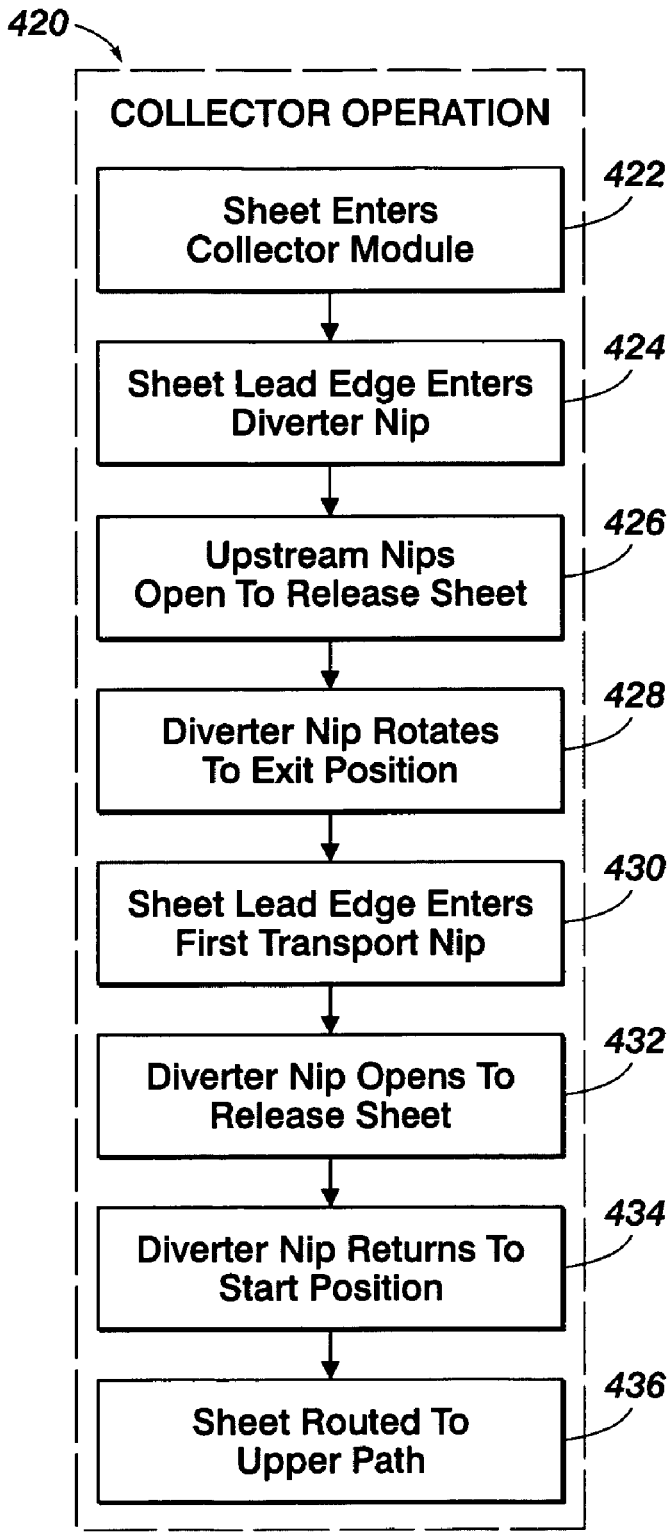
FIG. 11 is a flow chart illustrating the operation of a collector module according to an exemplary embodiment of this disclosure.

With reference to FIG. 11, illustrated is an exemplary method 420 of operating the collector module illustrated in FIGS. 10A and 10B. Initially, a print media sheet enters 422 the collector module at the entry nips 392, 394 and 396.

Next, the print media sheet leading edge enters 424 the rotary/diverter nips 372, 374 and 376, and the upstream transport nips 392, 394, and 396 open to release 426 the print media sheet.

Next, the diverter nips 372, 374 and 376 rotate 428 by means of a pivoting arm 371 which pivots about pivot center 369 to a print media exit position.

Next, the print media sheet leading edge enters 430 nips 380, 406 and 404 and the rotary/diverter hips 372, 374 and 376 release 432 the print media sheet.

Finally, the rotary/diverter nips 372, 374, and 376 are returned 434 to the print media sheet entrance position by the pivoting arm 371, 434 and the diverted/rotated sheet is routed 436 to the upper path exit nip 370.

Figure 12A:
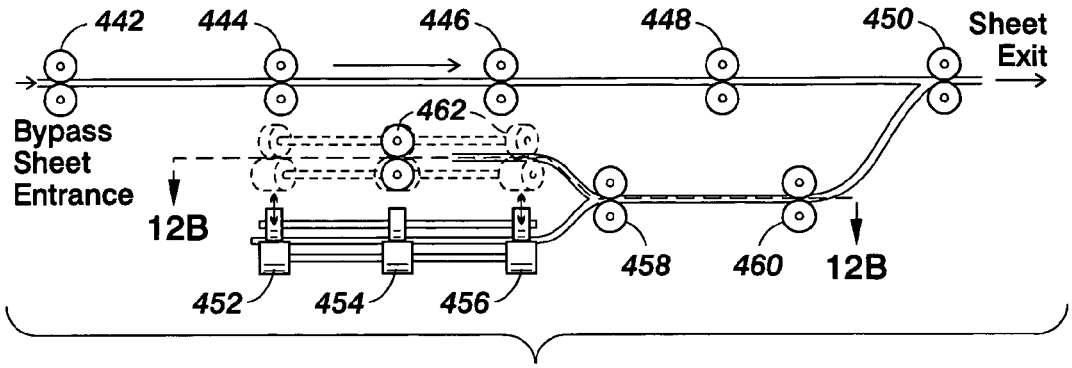
FIG. 12A is a side view of a collector module according to an exemplary embodiment of this disclosure.
Figure 12B:
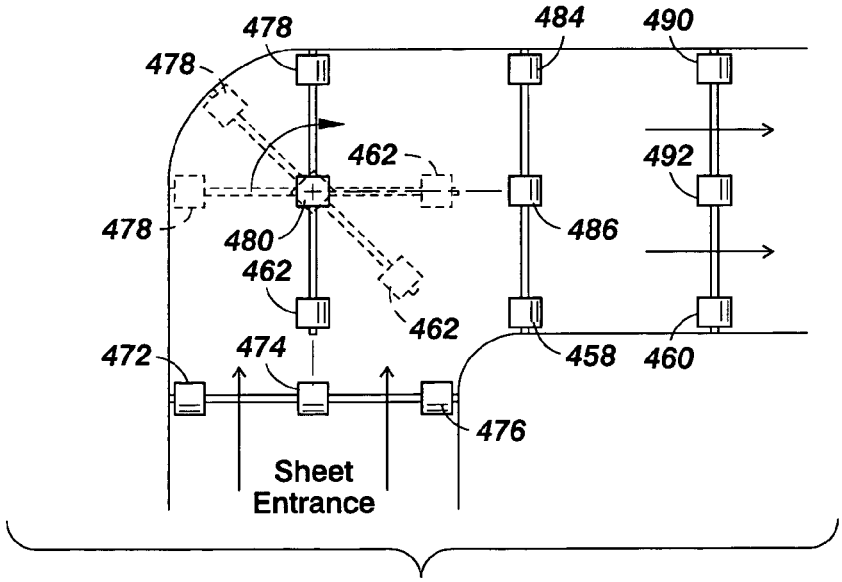
FIG. 12B is a top view (view "12B" indicated in FIG. 12A) of a collector according to an exemplary embodiment of this disclosure.

With reference to FIGS. 12A and 12B, illustrated is a side view and sectional top view, respectably, of a collector module according to another exemplary embodiment of this disclosure. The collector module comprises a print media rotary transport and a print media rotary transport bypass. The print media rotary transport comprises transport nips 472, 474, and 476; an upper stage pivoting arm comprising rotary nips 462, 480 and 478; a lower stage pivoting arm comprising rotary nips 452, 454 and 456; and exit nips 458, 486, 484, 460, 492 and 490. The print media rotary transport comprises entry nip 442; and transport nips 444, 446, 448 and 450.

With reference to FIG. 13, a method 500 of operating a collector module according to FIGS. 12A and 12B is illustrated.

Initially, a printing module directs 502 a first media sheet to the collector module entrance.

Next, the rotary table is positioned 504 so that the upper stage nips are oriented with the input paper travel direction.

Next, a diverter gate (not shown) directs 506 the first media sheet into the upper stage nip of the rotary table.

Next, the first media sheet is controlled 508 by the upper stage nip of the rotary table.

Next, the rotary table indexes 510 90 degrees about a vertical pivot axis. The first media sheet is rotated 90 degrees and the upper stage is now aligned with the media sheet exit direction while the lower stage is aligned with the media sheet input direction.

Next, the first media sheet enters 512 the orthogonal exit nip and merges onto the collection highway via nip 450.

Next, the printing module transports 514 a second sheet to the collector module.

Next, a diverter gate (not shown) directs 516 the second media sheet into the lower stage nip of the rotary table.

Next, the second media sheet is controlled 518 by the lower stage nip and the upstream nips are released.

Next, the rotary table indexes 520 90 degrees about a vertical pivot axis and the second media sheet is now rotated 90 degrees. This results in the lower stage being aligned with the media sheet exit direction and the upper stage being aligned with the media sheet input direction.

Next, the above steps are repeated 522 for subsequent sheets.

Figure 14A:
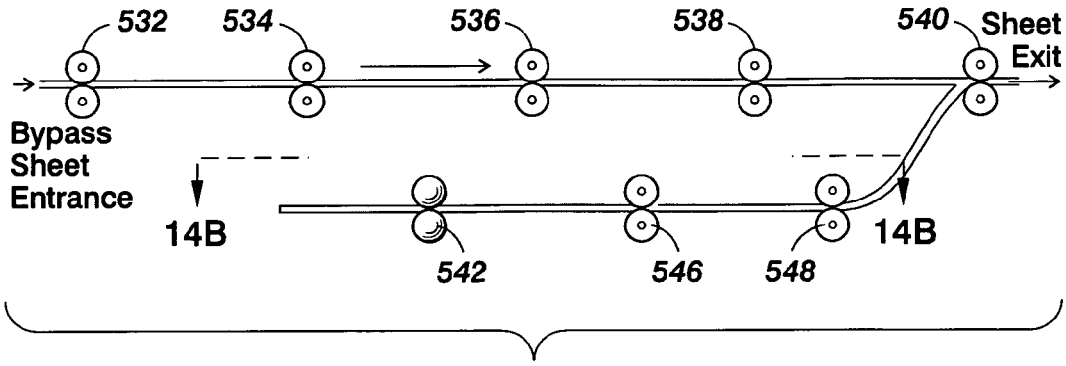
FIG. 14A is a side view of a collector module according to an exemplary embodiment of this disclosure.
Figure 14B:
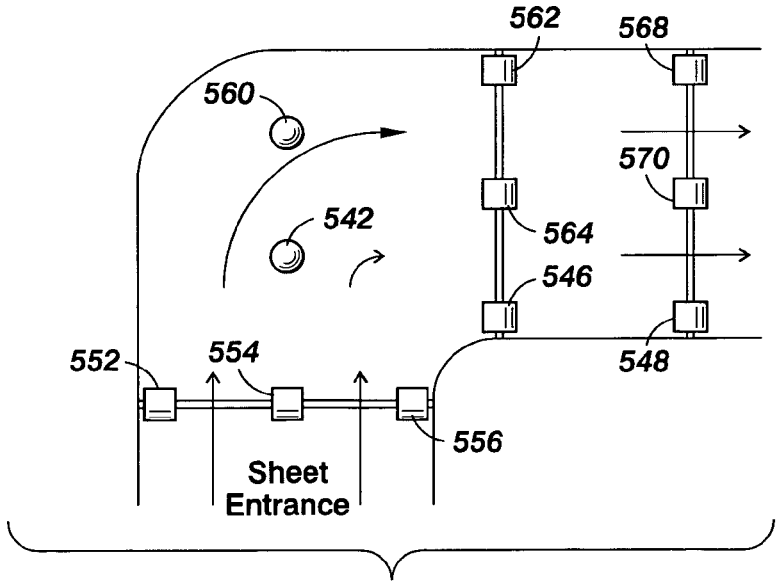
FIG. 14B is a top view (view "14B" identified in FIG. 14A) of a collector according to an exemplary embodiment of this disclosure.

With reference to FIG. 14A and FIG. 14B, illustrated is a side view and sectional top view, respectively, of a collector module according to another exemplary embodiment of this disclosure. The collector module comprises a print media rotary transport and a print media rotary transport bypass. The print media rotary transport comprises transport nips 552, 554 and 556; rotary nips 542 and 560; transport nips 546, 564 and 562; and exit nips 548, 570 and 568. The print media rotary transport bypass comprises transport nips 532, 534, 536, 538 and 540.

Notably, the collector module illustrated in FIGS. 14A and 14B operates similarly to the collector module illustrated and described with reference to FIGS. 10A and 10B, except the print media rotary transport includes spherically shaped rotary nips 542 and 560. The spherically shaped rotary nips 542 and 560 provide 90 degree indexing/rotation of a media sheet.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A print media rotary transport apparatus comprising:

a print media input;

a print media rotary bypass operatively connected to the print media input, the print media rotary bypass substantially horizontally aligned with the print media input;

a print media rotary transport operatively connected to the print media input, the print media rotary transport vertically offset from the print media rotary bypass and located substantially parallel to the print media rotary bypass;

a first print media output operatively connected to the print media rotary bypass; and a second print media output operatively connected to the print media rotary transport, the second print media output substantially orthogonal to the first print media output;

wherein the print media rotary bypass is configured to selectively receive a print media sheet and transport the print media sheet to the first print media output, and the print media rotary transport is configured to selectively receive a print media sheet, rotate the print media sheet about an axis orthogonal to the print media sheet plane, and transport the rotated print media sheet to the second print media output.

2. The print media rotary transport apparatus according to claim 1, wherein the first print media output is configured to transport a print media sheet to a first print media transport module, and the second print media output is configured to transport a print media sheet to a second print media transport module.

3. The print media rotary transport according to claim 1, wherein the first print media output is configured to transport a print media sheet to a print media transport module, and the second print media output is configured to transport a print media sheet to a printing module for image marking.

4. The print media rotary transport according to claim 3, the print media rotary transport further comprising:

a pivoting arm; and one or more pivoting arm pinch nips, the one or more pivoting arm pinch nips operatively connected to the pivoting arm and aligned to advance a print media sheet along a common plane, wherein the print media rotary transport is configured to rotate the pivoting arm a predetermined angle for transporting a print media sheet from the print media input to the second print media output.

5. The print media rotary transport according to claim 3, the print media rotary transport further comprising:

one or more spherical nips, the one or more spherical nips aligned to rotate a print media sheet a predetermined angle.

6. The print media rotary transport apparatus according to claim 1, the print media rotary transport further comprising:

a pivoting arm; and one or more pivoting arm pinch nips, the one or more pivoting arm pinch nips operatively connected to the pivoting arm and aligned to transport a print media sheet along a common plane, wherein the print media rotary transport is configured to rotate the pivoting arm a predetermined angle to transport a print media sheet.

7. The print media rotary transport apparatus according to claim 6, the print media rotary bypass comprising:

one or more nips aligned to transport a print media sheet from the print media input to the first print media output;

the print media rotary transport comprising:

one or more pinch nips aligned to transport a print media sheet to the pivoting arm pinch nips.

8. The print media transport apparatus according to claim 7, further comprising:

a print media input decision gate, wherein a first position of the decision gate routes print media to the print media rotary bypass and a second position of the decision gate routes print media to the print media rotary transport.

9. The print media transport apparatus according to claim 6, wherein the one or more pivoting arm pinch nips are configured to advance a print media sheet as the pivoting arm rotates.

10. A printing system comprising:

a first printing module comprising:

a print media input; and a print media output; and a print media diverter module comprising:

a print media input;

a print media rotary bypass operatively connected to the print media input, the print media rotary bypass substantially horizontally aligned with the print media input;

a print media rotary transport operatively connected to the print media input, the print media rotary transport vertically offset from the print media rotary bypass and located substantially parallel to the print media rotary bypass;

a first print media output operatively connected to the print media rotary bypass; and a second print media output operatively connected to the print media rotary transport, the second print media output substantially orthogonal to the first print media output;

wherein the print media rotary bypass is configured to selectively receive a print media sheet and transport the print media sheet to the first print media output, and the print media rotary transport is configured to selectively receive a print media sheet, rotate the print media sheet about an axis orthogonal to the print media sheet plane, and transport the rotated print media sheet to the second print media output which routes the print media sheet to the first printing module print media input for subsequent image marking.

11. The printing system according to claim 10, further comprising:

a second printing module comprising:

a print media input; and a print media output;

a second print media diverter module comprising:

a print media input;

a print media rotary bypass operatively connected to the print media input, the print media rotary bypass substantially horizontally aligned with the print media input;

a print media rotary transport operatively connected to the print media input, the print media rotary transport vertically offset from the print media rotary bypass and located substantially parallel to the print media rotary bypass;

a first print media output operatively connected to the print media rotary bypass; and a second print media output operatively connected to the print media rotary transport, the second print media output substantially orthogonal to the first print media output;

wherein the print media rotary bypass is configured to selectively receive a print media sheet and transport the print media sheet to the first print media output, and the print media rotary transport is configured to selectively receive a print media sheet, rotate the print media sheet about an axis orthogonal to the print media sheet plane, and transport the rotated print media sheet to the second print media output which routes the print media sheet to the second printing module print media input for subsequent image marking.

12. The printing system according to claim 11, further comprising:

a first print media collector module comprising:

a first print media input;

a second print media input operatively connected to the first printing module print media output; and a print media output, wherein the collector module is configured to rotate a print media sheet routed from the first printing module print media output to a predetermined angle for routing the print media sheet to the print media output, and the collector module is configured to selectively route a printed media sheet from the first print media sheet input to the print media output; and a second print media collector module comprising:

a first print media input;

a second print media input operatively connected to the second printing module print media output; and a print media output, wherein the collector module is configured to rotate a print media sheet routed from the second printing module print media output a predetermined angle for routing the print media sheet to the print media output, and the collector module is configured to selectively route a printed media sheet from the first print media sheet input to the print media sheet output.

13. The printing system according to claim 12, further comprising:

a first print media transport module operatively connected to the first print media diverter module print media output, and the second print media diverter module print media input;

a second print media transport module operatively connected to the first print media collector module first print media input, and the second print media collector module print media output.

14. The printing system according to claim 13, further comprising:

a print media sheet feeder operatively connected to the first print media diverter module.

15. The printing system according to claim 13, further comprising:

a print media sheet stacker operatively connected to the first print media collector module.

16. The printing system according to claim 13, further comprising:

a print media finishing module operatively connected to the first print media collector module.

17. The printing system according to claim 10, further comprising:

a print media transport module operatively connected to the first print media diverter module print media input.

18. The printing system according to claim 10, further comprising:

a print media collector module comprising:

a first print media input;

a second print media input operatively connected to the first printing module print media output; and a print media output, wherein the collector module is configured to rotate a print media sheet routed from the first printing module print media output a predetermined angle for routing the print media sheet to the print media output, and the collector module is configured to selectively route a print media sheet from the first print media sheet input to the print media sheet output.

19. The printing system according to claim 18, further comprising:

a print media transport module operatively connected to the print media collector print media output.

20. The printing system according to claim 18, further comprising:

a print media transport module operatively connected to the print media collector first print media input.

21. The printing system according to claim 10, further comprising:

a print media transport module operatively connected to the first print media diverter module first print media output.

* * * * *